US011191132B2

(12) United States Patent
Lee et al.

(10) Patent No.: US 11,191,132 B2
(45) Date of Patent: Nov. 30, 2021

(54) COOKER DEVICE AND METHOD FOR CONTROLLING AUTOMATIC OPENING OF DOOR OF COOKER DEVICE

(71) Applicant: LG Electronics Inc., Seoul (KR)

(72) Inventors: Dae Yong Lee, Seoul (KR); Hang Bok Lee, Seoul (KR); Hanjin Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 262 days.

(21) Appl. No.: 16/019,803

(22) Filed: Jun. 27, 2018

(65) Prior Publication Data

US 2019/0008006 A1 Jan. 3, 2019

(30) Foreign Application Priority Data

Jun. 28, 2017 (KR) ..... 10-2017-0082078

(51) Int. Cl.

| | |
|---|---|
| ***H05B 6/64*** | (2006.01) |
| ***F24C 15/02*** | (2006.01) |
| ***F24C 7/08*** | (2006.01) |
| ***E05F 15/73*** | (2015.01) |

(52) U.S. Cl.

CPC ..... *H05B 6/6447* (2013.01); *E05F 15/73* (2015.01); *F24C 7/085* (2013.01); *F24C 7/086* (2013.01); *F24C 15/022* (2013.01); *F24C 15/023* (2013.01); *H05B 6/6417* (2013.01)

(58) Field of Classification Search

CPC ..... F24C 7/085; F24C 7/086; F24C 15/022; F24C 15/023; E05F 15/73

See application file for complete search history.

(56) References Cited

U.S. PATENT DOCUMENTS 8,931,400 B1 * 1/2015 Allen ..... G08B 21/182 99/344
2003/0056328 A1 * 3/2003 Habegger ..... E05F 5/10 16/343

(Continued)

FOREIGN PATENT DOCUMENTS

DE 10200926659 12/2010
DE 102009026659 A1 * 12/2010 ..... F24C 15/024

(Continued)

OTHER PUBLICATIONS

European Extended Search Report in European Application No. 18180336.2, dated Nov. 15, 2018, 8 pages.

*Primary Examiner* — John J Norton
(74) *Attorney, Agent, or Firm* — Fish & Richardson P.C.

(57) ABSTRACT

A cooker device includes a main body that defines a cooking chamber and that defines an opening at a front of the main body, a door configured to open and close at least a portion of the opening, an opening assembly configured to apply force to the door and cause the door to pivot relative to the main body based on the force, a proximity sensor configured to sense a proximity of an object located in front of the cooker device, an input interface configured to receive an opening command based on the proximity of the object sensed by the proximity sensor, a control unit configured to, based on the opening command, control the opening assembly to apply force to the door, and a display that is configured to indicate an operating state of the cooker device.

19 Claims, 7 Drawing Sheets

(56) References Cited

U.S. PATENT DOCUMENTS

| | | | | |
|---|---|---|---|---|
| 2010/0235667 | A1* | 9/2010 | Mucignat | H04W 52/0254 713/323 |
| 2018/0245391 | A1* | 8/2018 | Margonari | F24C 15/023 |
| 2018/0328593 | A1* | 11/2018 | Grobleben | E05F 15/627 |
| 2018/0372326 | A1* | 12/2018 | Park | H04M 1/725 |

FOREIGN PATENT DOCUMENTS

| | | | | |
|---|---|---|---|---|
| DE | 102011010906 | | 8/2012 | |
| DE | 102005110292 | | 12/2016 | |
| EP | 0632180 | | 1/1995 | |
| EP | 1995522 | | 11/2008 | |
| EP | 2428153 | | 3/2012 | |
| EP | 2584271 | | 4/2013 | |
| EP | 2784398 | | 10/2014 | |
| JP | 2011158179 | A | 8/2011 | |
| JP | 2016014484 | | 1/2016 | |
| JP | 2016014484 | A * | 1/2016 | H03K 17/962 |
| KR | 20170055856 | | 5/2017 | |
| WO | WO 2017104172 | | 6/2017 | |

* cited by examiner

COOKER DEVICE AND METHOD FOR CONTROLLING AUTOMATIC OPENING OF DOOR OF COOKER DEVICE

CROSS-REFERENCE TO RELATED APPLICATIONS

This application claims the priority of Korean Patent Application No. 10-2017-0082078 filed on Jun. 28, 2017, in the Korean Intellectual Property Office, the disclosure of which is hereby incorporated by reference in its entirety.

TECHNICAL FIELD

The present disclosure relates to a method for controlling automatic opening of a door of a cooker device.

BACKGROUND

A cooker device such as an oven or a microwave oven may have a rectangular parallelepiped appearance. The device may include an inner cooking chamber defined therein and an open front at which a door is disposed. The door may be opened in various ways. For example, a hinge-connected door pivots about a rotational axis. The hinge type door may have a grip or groove that the user may grasp.

In some examples, a cooker device may have a function of automatically opening and closing a door of to the cooking device. In some cases, the automatic opening of the door implemented in a cooker device may be not familiar to a user. In some cases, how to use of the automatic door opening may be not intuitive to the user. In some cases, the user may need to learn how to use the automatic door opening.

In some cases, an accident may occur when the door is incompletely opened or opened regardless of the user's intention.

SUMMARY

One object of the present disclosure is to provide a method for controlling automatic opening of a door of a cooker device, whereby how to use of the automatic door opening may be intuitive to the user, and, thus, the user needs not to learn how to use the automatic door opening separately.

Another object of the present disclosure is to provide a method for controlling automatic opening of a door of a cooker device, whereby sensors installed for controlling the automatic opening of the door may be prevented from malfunctioning or a control unit receiving signals from the sensors may be prevented from malfunctioning.

Another object of the present disclosure is to provide a method for controlling automatic opening of a door of a cooker device, whereby power consumed for activating various electronic devices installed to implement the automatic opening of the door may be minimized and thus the energy reduction efficiency may be improved.

According to one aspect of the subject matter described in this application, A cooker device includes a main body that defines a cooking chamber and that defines an opening at a front of the main body, a door configured to open and close at least a portion of the opening, an opening assembly configured to apply force to the door and cause the door to pivot relative to the main body based on the force, a proximity sensor configured to sense a proximity of an object located in front of the cooker device, an input interface configured to receive an opening command based on the proximity of the object sensed by the proximity sensor, a control unit configured to, based on the opening command, control the opening assembly to apply force to the door, and a display that is configured to indicate an operating state of the cooker device.

Implementations according to this aspect may include one or more of the following features. For example, the door may have a first upper region at which the input interface is located, a second upper region at which the proximity sensor is located, and a central upper region located horizontally between the first upper region and the second upper region. The display is located at the central upper region of the door. In some examples, the input interface includes at least one of a touch sensor configured to detect a touch input or a motion sensor configured to detect motion. In some examples, the opening assembly is located inside of the main body vertically above the cooking chamber.

In some implementations, the cooker device further includes a hinge that is configured to pivotably couple the door to the main body, that is located at a bottom of the door, and that extends in a direction along the bottom of the door. In some implementations, the cooker device further includes an elastic unit configured to apply force to the door to cause the door to pivot toward the opening, and the control unit is configured to control the opening assembly to apply force to the door to cause the door to open to a position corresponding to a predetermined angle relative to the main body. The door may be further configured to pivot downward by a weight of the door based on the door being opened to the position corresponding to the predetermined angle relative to the main body, where the force applied by the elastic unit is less than a downward pivot force applied to the door due to the weight of the door based on the door being opened to the position corresponding to the predetermined angle.

According to another aspect, a method for controlling a cooker device that has similar features to the device described above includes monitoring, by the proximity sensor, an area in front of the cooker device, detecting, by the proximity sensor, an object located at a proximal region within the area in front of the cooker device, and based on detection of the object in the proximal region, activating, by the control unit, the illumination unit.

Implementations according to this aspect may include one or more of the following features. For example, the method may further include based on detection of the object in the proximal region, activating the input interface, by the control unit, to enable the input interface to receive the opening command, and in response to receipt of the opening command at the input interface, controlling, by the control unit, the opening assembly to apply force to the door to cause the door to pivot relative to the main body. In some examples, the method may further include activating, by the control unit, the illumination unit and the input interface at a same time. In some examples, the input interface includes at least one of a touch sensor configured to detect a touch input or a motion sensor configured to detect motion, where the method further includes activating, by the control unit, the input interface and at least one of the touch sensor or the motion sensor at a same time.

In some implementations, the method further includes deactivating, by the control unit, the proximity sensor based on the door being at least partially opened, and activating, by the control unit, the proximity sensor based on the door being closed. In some examples, the cooker device further includes a display that is configured to indicate an operating state of the cooker device, where the method further includes turning on, by the control unit, the display based on detection of the object in the proximal region.

In some implementations, the method further includes, based on detection of the object in the proximal region, determining whether a power supply button of the cooker device is pressed, based on a determination that the power supply button is pressed in a state in which the object is located in the proximal region, deactivating, by the control unit, the illumination unit, the input interface, and the display, and maintaining, by the control unit, deactivation of the illumination unit, the input interface, and the display for a predetermined duration.

In some implementations, the display is further configured to detect touch on the display, where the method further includes deactivating, by the control unit, the display based on lack of detection of touch on the display for a wait time after activation of the display. In some implementations, the method further includes receiving an operation command at the display, determining, by the control unit, an execution command corresponding to the operation command, based on a determination that the operation command corresponds to an execution command for cooking, turning on, by the control unit, a light-emitting diode (LED) located on the door, determining whether cooking is currently executed, and based on a determination that cooking is currently executed, controlling, by the control unit, the LED to maintain emission of light.

In some implementations, the method further includes determining, by the control unit, whether the door is open while the LED emits light, and based on a determination that the door is open while the LED emits light, turning off, by the control unit, the LED. In some implementations, the opening assembly is located inside of the main body vertically above the cooking chamber. In some implementations, the cooker device further includes a hinge that is configured to pivotably couple the door to the main body, that is located at a bottom of the door, and that extends in a direction along the bottom of the door.

In some implementations, the cooker device further includes an elastic unit configured to apply force to the door to cause the door to pivot toward the opening, where the method further includes controlling, by the control unit, the opening assembly to apply force to the door to cause the door to open to a position corresponding to a predetermined angle relative to the main body. The door may be further configured to pivot downward by a weight of the door based on the door being opened to the position corresponding to the predetermined angle relative to the main body, where the force applied to the door toward the opening by the elastic unit is less than downward force applied to the door by the weight of the door at the position corresponding to the predetermined angle.

In some implementations, the method further includes slowing down a speed of downward pivot motion of the door based on the door being opened to a position corresponding to an angle that is greater than or equal to the predetermined angle relative to the main body.

In some implementations, the opening command input interface and display are deactivated before the proximity sensor detects that a person is in proximity. Thereby, the standby power can be minimized.

In some implementations, with the person in proximity to the proximity sensor, the illumination unit in the opening command input interface is turned on, and the display is turned on. This allows the user to intuitively identify currently available input items, thereby enhancing the convenience of the user.

In some implementations, the illumination unit and the opening command input interface cooperate in a coinciding manner with each other. Thus, the user may intuitively check, via assistance of the illumination the illumination unit, whether the interface is in an activated state.

In some implementations, the above-mentioned opening command input interface may be embodied in a touch or a motion sensing manner. Thus, the user may have great convenience.

In some implementations, when the proximity sensor detects that a person is in front of the cooker device, and when the user does not intend to operate the cooker device, the power supply button is pressed immediately. In this response, the opening command input interface and display may be deactivated. Then, this deactivation state lasts for a few seconds. This ensures that the opening command input interface and display remain at the deactivated status until the user leaves the cooker device.

In some implementations, the proximity sensor is deactivated with the door being open. With the door closed, the proximity sensor is activated. Thus, the power supply to the proximity sensor may be saved, and malfunction of the device due to malfunction of the proximity sensor may be prevented in advance.

In some implementations, when a person is detected in front of the cooker device by the proximity sensor, and when the user does not input any command on the display for a few minutes, the power supply otherwise used due to the activation of the display may be saved by deactivation of the display.

In some implementations, the operation state of the cooker device may be visually checked via the illumination of the door LED. When the door is opened during cooking, the door LED may be turned off to reduce the uncomfortable feeling of the user.

DETAILED DESCRIPTIONS

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Hardware Structure of Cooker Device

Hereinafter, a hardware structure of a cooker device employing a method for controlling automatic door opening according to the present disclosure will be described first.

Figure 1:
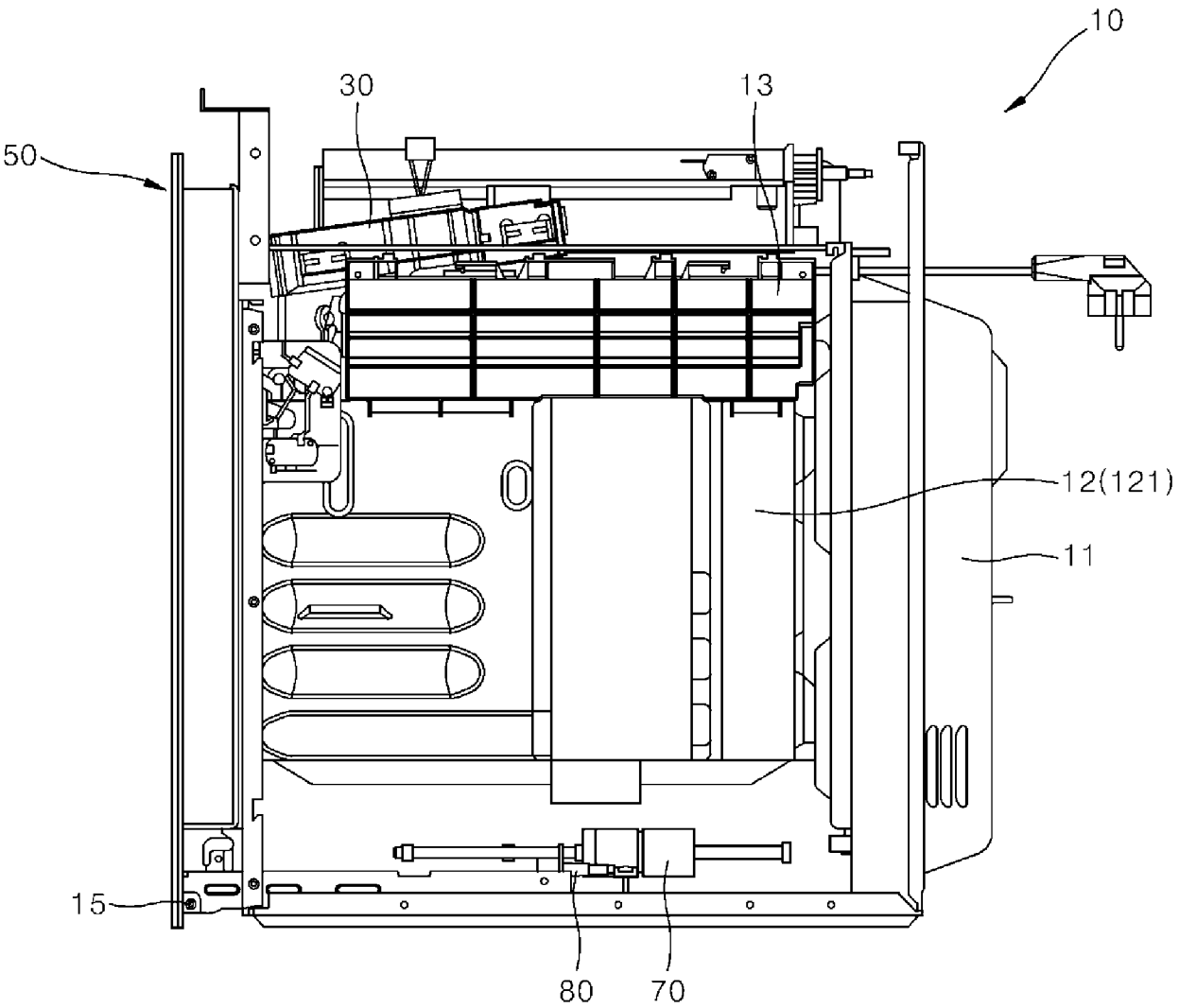
FIG. 1 is a side elevation view showing an example of a cooker device employing a method for controlling automatic door opening with a sidewall of an outer housing of a main body being removed.

FIG. 1 illustrates an oven as one example of a cooker device. However, the present disclosure is not limited to the oven, and may be applied to various cooker devices.

The cooker device may include a main body 10 having a substantially rectangular parallelepiped shape with an open front and an inner space defined therein; and a door 50 provided in front of the main body 10.

The main body 10 may include an outer housing 11 forming an appearance of the overall cooker device; and an inner housing 12 provided inside the outer housing 11 and having a cavity 121 defined therein, which is opened frontward. The cavity defines a cooking chamber.

The main body 10 has a top room 13 defined above the cavity 121. Various components necessary for the operation of the oven are disposed in the top room 13. Another cooker device using a different cooking scheme from that of the oven may be placed on the top room. In the top room 13, an automatic opening assembly 30 is provided to provide an actuation force for the automatic opening of the door.

The automatic opening assembly 30 includes a push bar 37. The push bar 37 moves forward relative to the main body 10 and pushes the door forward with respect to the main body 10. The inside of the oven rises to about 450 degrees Celsius. This temperature may cause the automatic opening assembly 30 to malfunction. For this reason, the automatic opening assembly is not installed beside or below the cooking chamber. Instead, the automatic opening assembly is preferably provided in the top room 13 that is relatively larger in space and allows the temperature of a surrounding space to be lowered.

The door 50 to be described later may be subjected to a force acting in a door closing direction from an elastic unit 70. Therefore, in order to easily overcome the force acting in the door closing direction from the elastic unit 70, it is preferable that a force for pressing the door in a front direction is generated from the top room as far away from a hinge axis of the door which is provided along a bottom of the door.

After the user opens the door of the cooker device, the user will put food into or pull out of the device while he is present in front of the cooker device. At this time, a sight of the user is directed toward a front upper center of the cooker device. Accordingly, when the automatic opening assembly 30 is positioned at a center of the top room 13 of the main body 10, the push bar 37 may be visible to the user.

In view of this, it is preferable that a position of the automatic opening assembly 30 is biased to the left or right of the cooker device. In this example, a structure in which the automatic opening assembly 30 is biased to the right of the device is illustrated. When the automatic opening assembly 30 is biased to one lateral side, a remaining space in the top room may be available.

When the push bar 37 is moved forward so that the door is forcibly opened by a slight angle, for example, about 10 degrees, an upper end of the door shields the user's sight so that the push bar 37 may not be present in the user's line of sight. To this end, therefore, it is preferable that the push bar 37 is disposed at a lower position in the top room 13. That is, an installation position of the automatic opening assembly 30 may be a left or right lower position of the top room 13.

However, in terms of space utilization of the top room 13, and as long as the push bar is not visible to the user, the installation position of the automatic opening assembly 30 in the space of the top room 13 may vary as necessary.

At the front of the main body 10, a door 50 for opening or closing the front of the cooking chamber is installed. An area size of the door 50 may be an area size adapted for opening or closing only a front of the cooking chamber. The present disclosure is not limited to this. As illustrated, the area of the door may be sized such that the door covers the front of the cooking chamber and a front of the top room 13 above the cooking chamber.

The door 50 is coupled to the main body 10 via a hinge 15 disposed at a front lower end of the main body 10. The hinge 15 serves as a pivot axis about which the door 50 pivots relative to the main body 10. The pivot axis extends laterally. Accordingly, the door 50 pivots forward downward with respect to the main body to open the chamber, and pivots backward upwardly to close the chamber.

The elastic unit 70 and a damper 80 are installed in a bottom region of the main body. The elastic unit 70 applies a force to the door in such a direction that the door pivots backward and upwardly i.e., closes the chamber. That is, the elastic unit 70 prevents the door from suddenly opening when the door begins to be opened and pivots downward. Further, when the door closes the chamber, the elastic unit 70 provides a force that allows the door to come into tight contact with the main body.

In some implementations, the damper 80 damps the pivoting force of the door when the door opens the chamber, allowing the door to open slowly. If desired, the damper 80 may be configured to apply a damping force to the door only when the door is opened. Alternatively, the damper 80 may be configured to apply the damping force to the door in both the opening direction and the closing direction of the door. Further, the damper may be configured to apply the damping force to the door over an entire pivot angle at which the door opens and closes. Alternatively, the damper may be configured to apply the damping force only over a certain range of the pivot angle.

Figure 2:
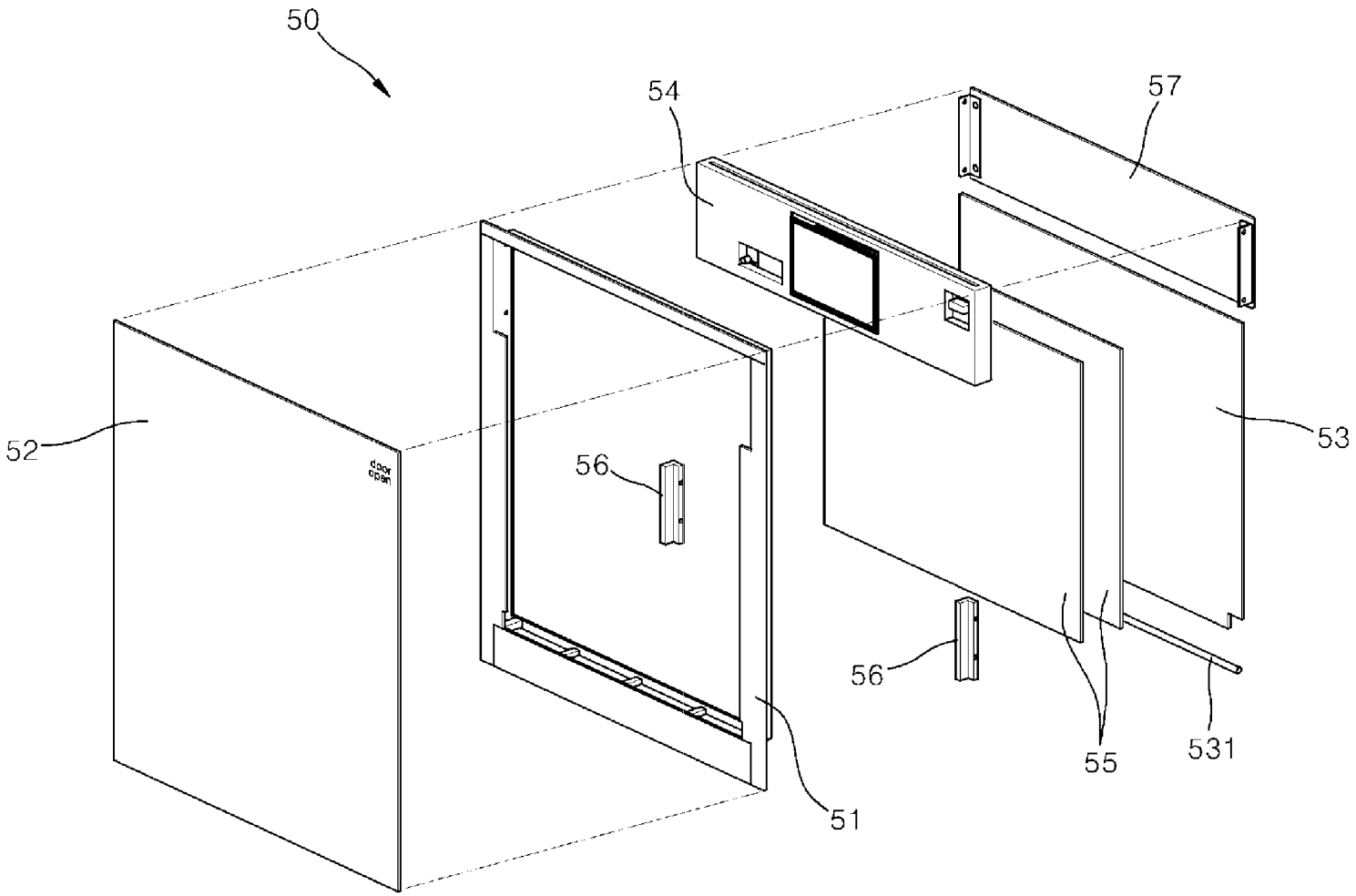
FIG. 2 is an exploded perspective view showing an example of a door installed in front of the main body of the cooker device of FIG. 1.
Figure 3:
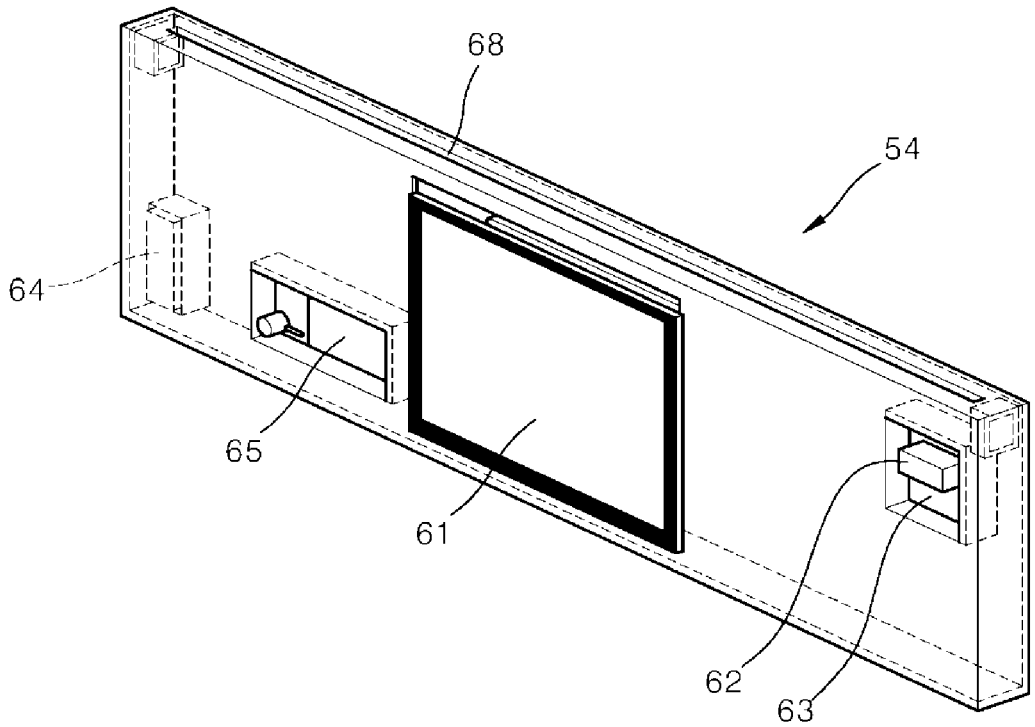
FIG. 3 is an enlarged perspective view showing an example of an inner supporter of the door of FIG. 2.

FIGS. 2 and 3 illustrate an example of a door installed in front of the main body of the cooker device and an example of an inner supporter of the door, respectively.

Referring to FIGS. 2 and 3, the door 50 has a frame 51. The frame 51 has a rectangular frame shape. The frame 51 has a frame having a size adapted for covering the cooking chamber and the top room on the cooking chamber.

Each of hinge brackets 56 may be installed at each of left and right sides of a bottom of the frame. The door 50 of the cooker device may contain several sheets of glass, so the weight thereof may also be significant. Therefore, it is necessary to reinforce a rigidity of a joint portion of the door 50 which is engaged with the hinge 15 during the pivoting process. The hinge bracket 56 further reinforces the rigidity of the door 50.

The frame 51 has a predetermined thickness in the front-rear direction. Front and rear reflective glasses 55 are disposed on a front-face and a rear-face of the frame 51 respectively. The reflective glass has a size adapted to cover the front of the cooking chamber and is fixed to an inner edge of the frame 51. The two glasses are spaced apart from each other.

Further, an inner supporter 54 is disposed in an upper region of the frame 51 and between the two reflective glasses. The inner supporter 54 has a size adapted to cover the top room 13 above the cooking chamber. The supporter is fixed to the inner edge of the frame 51. A sum of the area of the inner supporter 54 and the area of the reflective glass corresponds roughly to the area of the inner hollow region of the frame 51.

At the rear of the door, an inner glass 53 is installed. A bottom of the inner glass 53 is fixed to the frame by an inner glass holder 531, while a top of the inner glass 53 is fixed to the frame by a door cover 57. The door cover 57 covers a rear face of the inner supporter 54 and is fixed to the frame.

Onto the front of the frame, an outer glass 52 is fixed thereto. The outer glass 52 covers an entire front-face of the frame. That is, the outer glass 52 covers the frame 51, the reflective glass 55 and the inner supporter 54, and is fixed to the frame 51.

A rear-face of the outer glass 52 is in close contact with a front-face of the inner supporter 54. In this example, in a right upper region of the inner supporter 54, an opening command input interface 62 is disposed in contact with or adjacent to an illumination unit 63. The illumination unit 63 may be embodied as a white LED. The opening command input interface may be implemented as a capacitive touch panel through which light is transmitted when the illumination unit 63 is turned on.

A specific mark indicating that an upper right region of the outer glass 52, which is a position corresponding to the opening command input interface 62 position-corresponds to the opening command input interface region may be printed on the upper right region of the outer glass 52. The mark may be in letter form, such as "DOOR OPEN." Alternatively, the mark may be an icon representing a shape indicating a state at which the door opens.

The position of the opening command input interface 62 and related features (illumination unit, mark, etc.) are not necessarily limited to the above example. The location of the opening command input interface 62 and associated features (illumination unit, mark, etc.) may be any location on the front-face of the inner supporter 54. However, as described above, the user manipulates the cooker device in front of the cooker device. Further, the user's gaze is expected to be directed toward the upper center of the front of the cooker device. The fact that a percentage of right-handed users among all users is greater than that of left-handed users may be further considered. Thus, the opening command input interface 62 may be located on the upper right region on the front-face of the inner supporter 54.

Only via simple touch manipulation on the opening command input interface 62, an opening command may be generated from the input interface 62. Alternatively, an opening command may be generated via touch and drag manipulation on the opening command input interface 62. Further, the opening command input interface 62 may include a touch panel or may be embodied as an interface employing various different input schemes. For example, the opening command input interface may be embodied as a motion sensor-based interface that senses motion.

A display 61 is installed on the front center portion of the inner supporter 54. An installation position of the display may also be set in consideration of the user's posture or position. That is, as described above, the user manipulates the cooker device in front of the cooker device. Further, the user's gaze is expected to be directed toward the upper center of the front of the cooker device. The fact that a percentage of right-handed users among all users is greater than that of left-handed users may be further considered. Thus, it is preferable that the display is located at the center of the inner supporter 54, which is a position corresponding to the front of the user's gaze, rather than being biased to the left or right. However, when the cooker device's door structure changes, and, hence, a position at which the user is expected to be in front of the cooker device changes, it goes without saying that the position of the display may be changed. The display also includes a touch panel, and various commands may be input on the touch panel.

A proximity sensor 64 is disposed in the lower left region of the inner supporter 54. The proximity sensor may be embodied as a sensor capable of sensing a movement as occurring within a predetermined distance therefrom. Alternatively, the proximity sensor may be embodied as a sensor capable of measuring a distance to an object in front of the sensor. That is, as long as the proximity sensor recognizes that there is a person in front of the cooker device, the proximity sensor may include sensors employing various human-presence sensing methods.

The mounting position of the proximity sensor is not limited to the position illustrated in the drawing. As long as the sensing region by the proximity sensor is capable of covering the front of the cooker device, the position of the proximity sensor may vary. However, according to the cooker device of this example, the display 61 is arranged at the front center portion of the inner supporter 54. The opening command input interface 62 is disposed on the right side of the supporter. Considering such arrangement, the proximity sensor is disposed in the left region of the supporter.

The cooking chamber in the cooker device may become quite hot. Thus, the heat of the cooking chamber will adversely affect various sensors or displays built into the inner supporter 54. In view of this, forcedly flowing air for cooling the door and the inside of the inner supporter may be employed. Therefore, when various sensors are concentrated inside the inner supporter, the cooling effect may be lowered.

For example, a user, predominantly a right-handed person, may lift his/her right arm and manipulate the opening command input interface 62 and display 61 by his/her hand. In this case, when the proximity sensor is on the right of the supporter, such manipulation behavior of the user may cause inaccuracy in the process of measuring the distance signal by the sensor. On the other hand, when the proximity sensor is located on the left side of the supporter, the manipulation behavior of the user may not be detected by the proximity sensor. This leads to accuracy in the process of measuring the distance signal by the sensor. Thus, the position of the proximity sensor is advantageous on the left side of the supporter in many respects.

In some implementations, a knock-on sensor 65 may further be disposed on the inner supporter 54.

When the user knocks the outer glass 52 in the region corresponding to the reflective glass 55, the knock-on sensor 65 is configured to recognize a sound generated by the knock and generate a corresponding signal. When a knock is first detected, the knock-on sensor 65 activates an illumination unit in the cooking chamber. When re-knock is detected, the knock-on sensor 65 turns off the illumination unit inside the cooking chamber. Thus, the knock-on sensor 65 may control the illumination unit for the cooking chamber.

The knock-on sensor may be positioned so as not to overlap with the display 61, the opening command input interface 62, and the proximity sensor 64, with the specified positions as described above. Thus, the knock-on sensor may be disposed between the proximity sensor 64 and the display 61, or between the display 61 and the opening command input interface 62.

In this example of the present disclosure, in order to allow the knock-on sensor to sense, at a minimum degree, a sound as generated when a user presses the opening command input interface 62, the knock-on sensor is disposed between the proximity sensor 64 and the display 61.

A door light emitting diode (LED) 68 for emitting light upward may be disposed on a top of the inner supporter 54. The door LEDs may be arranged in an array. Alternatively, the door LED may be disposed only on the left and right sides, and a diffusion plate may be provided therebetween.

Since the automatic opening assembly 30 described above automatically opens the door, the door need not have a separate handle. As a result, a knob disposed in front of the oven door may be omitted, and, hence, a design of the oven may be further upgraded.

Method for Controlling Automatic Opening of Door

Figure 4:
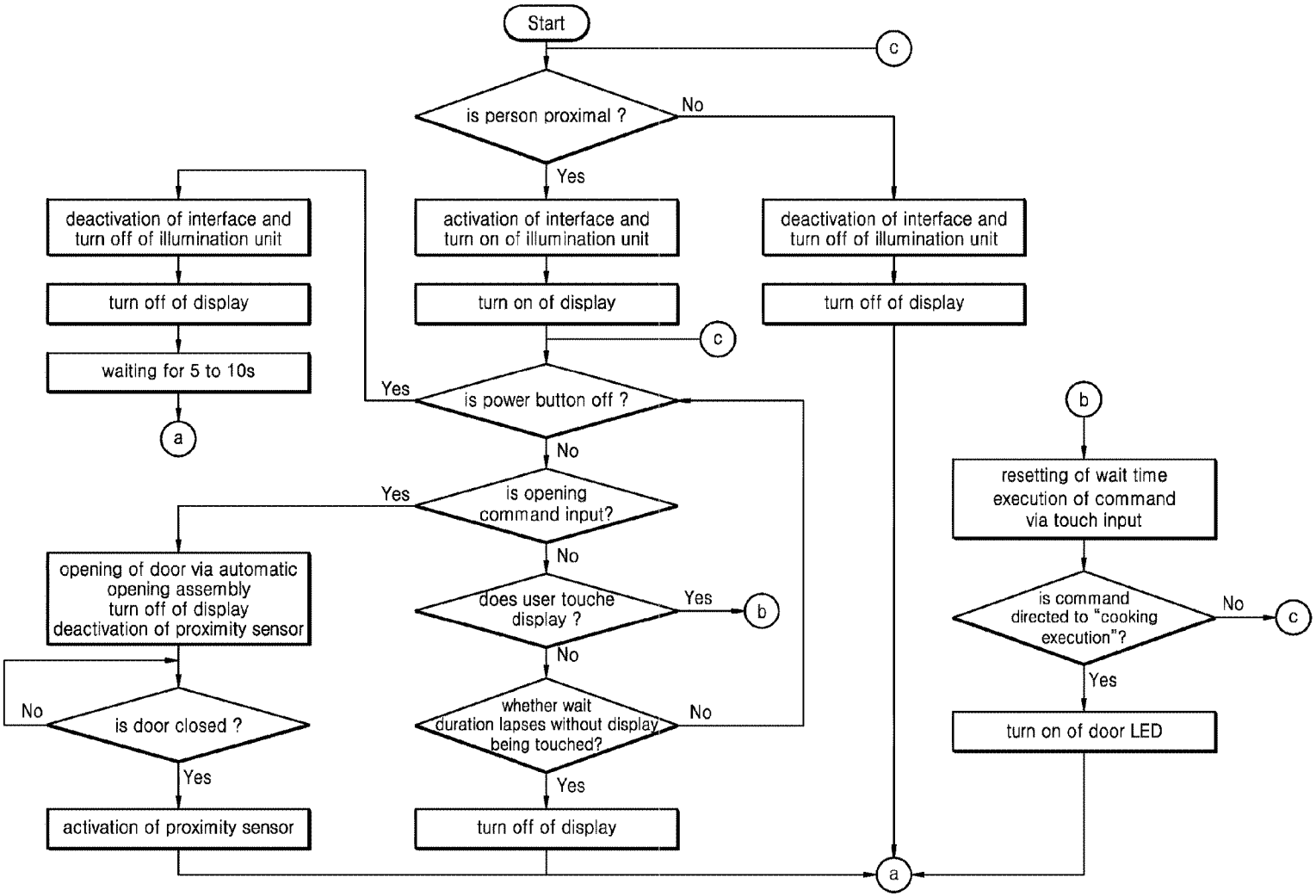
FIG. 4 is a flow chart showing an example method for controlling automatic door opening.

FIG. 4 illustrates an example method for controlling automatic opening of a door of a cooker device.

The proximity sensor 64 is activated while the door 50 is closed. The proximity sensor may be deactivated when the door is opened. With the door being closed, the proximity sensor periodically detects whether there is a person in front of the sensor. While a person is being detected, the proximity sensor generates a signal indicating that a person has been detected, and, then, transmits the signal to a control unit such as a microcomputer.

When the proximity sensor 64 does not detect that there is a person in front of the cooker device, that is, when there is no person in front of the cooker device, the opening command input interface 62 is disabled, the illumination unit 63 is also kept off, and the display 61 remains off. In this state, the mark "DOOR OPEN" on the outer glass is not visible, and, the display is not visible.

On the other hand, when the proximity sensor 64 senses that a person is approaching the person or is present in front of the cooker device, the opening command input interface 62 is activated, the illumination unit 63 is turned on, and the display 61 is turned on. In this state, the "DOOR OPEN" mark on the outer glass is noticeable, and the display is also visible through the outer glass 52.

Therefore, a person approaching the cooker device to operate the cooker device may recognize the turned-on display and illumination unit. Accordingly, the user may intuitively know that a target command input is available to the device. Then, the user may touch the display to input a command, or touch the opening command input interface 62 to automatically open the door.

As used herein, the opening command input interface 62 being activated may refer to a state in which a command may be input via manipulation including a touch on the opening command input interface 62 by a user. Conversely, the opening command input interface 62 being deactivated may refer to a state in which a command cannot be input via an operation including a touch or the like on the opening command input interface 62 by the user.

The opening command input interface 62 and the illumination unit 63 may cooperate in a mutually-associating manner. That is, when the opening command input interface 62 is activated, the illumination unit 63 is also turned on. Conversely, with the opening command input interface 62 being inactive, the illumination unit 63 may be turned off. This cooperating scheme in the mutually-associating manner allows the user to intuitively know whether the opening command input interface 62 is enabled or disabled. This may be performed under control of the control unit.

In some implementations, the on/off of the illumination unit 63 may correspond to the activation/deactivation of the opening command input interface 62, respectively. In some implementations, the activation/deactivation of the opening command input interface 62 may correspond to the activation/deactivation of the touch sensor or motion sensor, onto which the touch or motion corresponding to the opening command input is performed. In the activated state of the touch sensor or motion sensor, the sensor responds to the touch or motion by the user. In the deactivated state of the touch sensor or motion sensor, the sensor cannot respond to the touch or motion by the user. In this connection, whether or not the sensor responds to the motion or touch may be determined depending on whether or not the power is supplied to the touch sensor or the motion sensor.

There is a situation in which a person is merely present before the cooker device with the intention not to run the cooker device. In this case, a separate power supply button may be provided to reduce power loss. The power supply button may be implemented as a hardware switch or an image button displayed on the display. With the display and illumination unit being turned on, that is, with the opening command input interface being activated, a person presses the power supply button. Then, the display and illumination unit are turned off, and the opening command input interface is deactivated. In this connection, a situation where the user may press the power supply button may include following situations: where the user has completed all manipulation of the cooker device and leaves before the cooker device; or where the user accesses the cooker device but does not intend to use the cooker device and only wants to turn off the display and the opening command input interface.

In some cases, although the power supply button has been pressed, the proximity sensor immediately detects that there is a person in front of the sensor. In this case, the display and the opening command input interface is likely to be activated again. With considering this case, when the user presses the power supply button, the display and the opening command input interface remain off only for a predetermined amount of time. This may be implemented via deactivation of the proximity sensor for several seconds, for example, 5 to 10 seconds. Alternatively, the display and opening command input interfaces may be controlled to be off for 5 to 10 seconds. The present disclosure is not limited to this. After the waiting time of 5 to 10 seconds has elapsed, the function may be initialized such that the proximity sensor may be activated again. This may be performed under control of the control unit.

Figure 5:
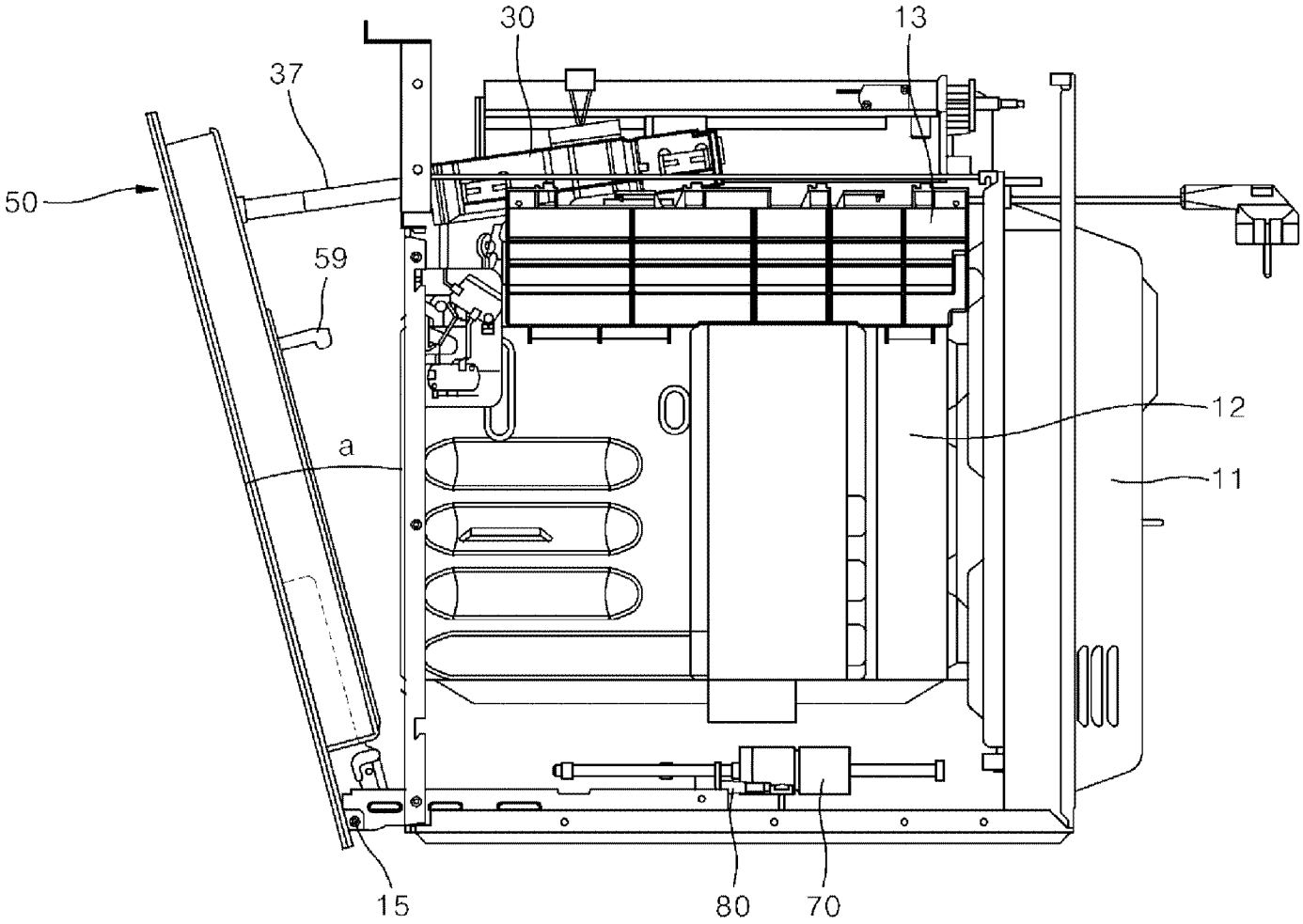
FIG. 5 is a side view showing an example state in which a door is opened forward by an automatic opening assembly based on input of a door opening command via a door opening command input interface.

FIG. 5 illustrates an example state in which a door is opened forward by an automatic opening assembly based on input of a door opening command via a door opening command input interface.

For example, when the proximity sensor 64 detects a person approaching the front of the cooker device, the automatic opening assembly 30 works via the user touching the activated opening command input interface 62. When the automatic opening assembly 30 is actuated, the automatic opening assembly 30 push the push bar 37 forward of the main body as illustrated in FIG. 5. The push bar 37 is linearly translated to be pushed forward, so that a tip of the push bar 37 pushes the rear-face of the door. Thus, the door pivots forward downward about the pivot axis at the bottom of the door.

In the case of a cooker device such as an oven, the elastic unit exerts a force on the door 50 in the door closing direction. For this reason, the push bar 37 forcibly opens the door 50 until the door pivot angle reaches an angle at which a force to open the door due to the weight of the door 50 overcomes the elastic force of the elastic unit in the door closing direction.

For example, the angle at which a force to open the door due to the weight of the door 50 overcomes the elastic force of the elastic unit in the door closing direction may be, for example, about 10 to 11°. In the example shown in FIG. 5, the angle may be about 10.6°. This angle may be referred to as a forcedly-opened angle. In some cases, the forcedly-opened angle may be less than 45° relative to the main body 10.

Figure 6:
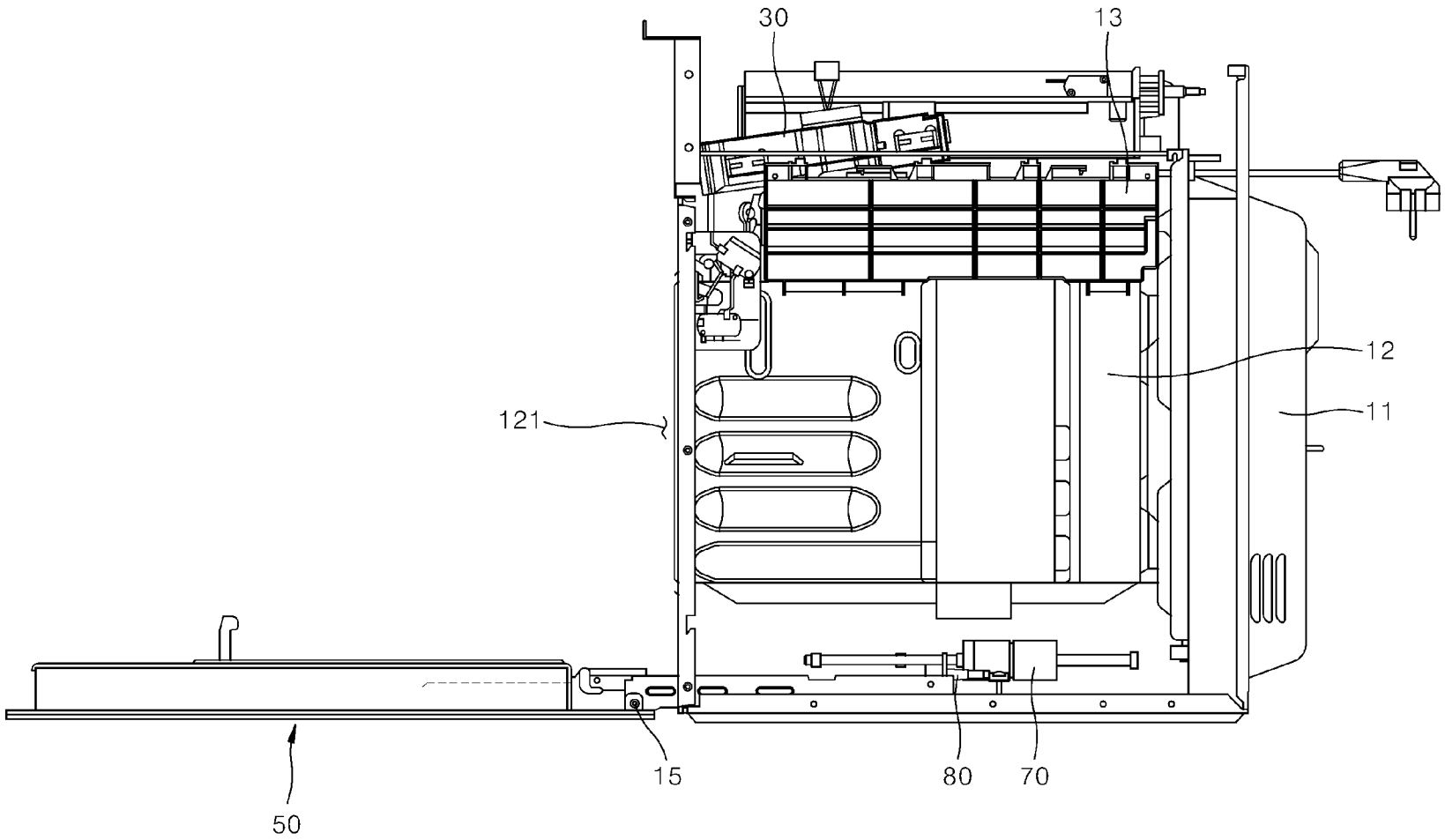
FIG. 6 is a side elevation view showing an example state in which the door of FIG. 5 is opened by its own weight based on the door being initially opened by the automatic opening assembly.

FIG. 6 illustrates an example state in which the door of FIG. 5 is opened by its own weight based on the door being initially opened by the automatic opening assembly.

For example, after the door reaches the forcedly opened angle, the door is self-opened due to the weight of the door as illustrated in FIG. 6. In some examples, the push bar 37 pushes the door forward until the door reaches the forcedly-opened angle a, and then, the push bar 37 immediately returns to the inside of the main body. In some cases, the push bar 37 returns within a certain time.

When the opening speed is accelerated while the door is opened by itself due to the weight thereof, an impact may be applied to the door at a lowest opened position. In consideration of this fact, according to the present disclosure, the damper 80 may be further provided to control the opening speed of the door to damp the opening force of the door so that the opening of the door is slowed. This may be performed under control of the control unit.

The damping angle range corresponding to the damping at which the damper 80 attenuates the opening force of the door is as follows: when the door reaches a pivot angle of, for example, about 30 degrees, damping starts and damping continues until the pivot angle reaches 90 degrees. In this way, after the door is opened to reach the forcedly-opened angle a, the door is quickly opened by its own weight. Then, when the pivot angle reaches about 30 degrees, the damping force of the damper acts to open the door slowly. This allows the user to feel a sense of safety.

Referring to FIG. 4, after the door is fully opened, as described above, the display 61 may be turned off and the opening command input interface 62 may be deactivated. With the door being fully opened, the display and the opening command input interface are oriented fully horizontally and in contact with the floor. This disables manipulation of the display and the opening command input interface by the user. Thus, the display is turned off to increase power saving efficiency. Further, the display may be prevented from being touched unexpectedly and activated, thereby preventing an unwanted command from entering the cooker device. For the same reason, after the door is fully opened, the proximity sensor may be turned off. This may be performed under control of the control unit.

When the door is closed again and the proximity sensor begins to reactivate, there is a person in front of the cooker device since the door is closed by the person. In this response, the display and the opening command input interface may be turned on again. This may be performed under control of the control unit.

Whether or not the door is closed may be detected, by detecting the presence of a hook extending rearward from the rear-face of the door in the main body, for example, via a further sensor disposed therein.

In some implementations, when the proximity sensor detects that there is a person in front of the cooker device and the display is turned on, the standby time (e.g., 5 minutes) for which the display is not touched by the user may lapse. In this case, the display may be turned off automatically to increase the power saving efficiency. This may be performed under control of the control unit. Thus, when the user is staying in front of the cooker device while doing something else that is not related to the device, a situation when the display is continuously on and power is wasted may be suppressed.

Figure 7A:
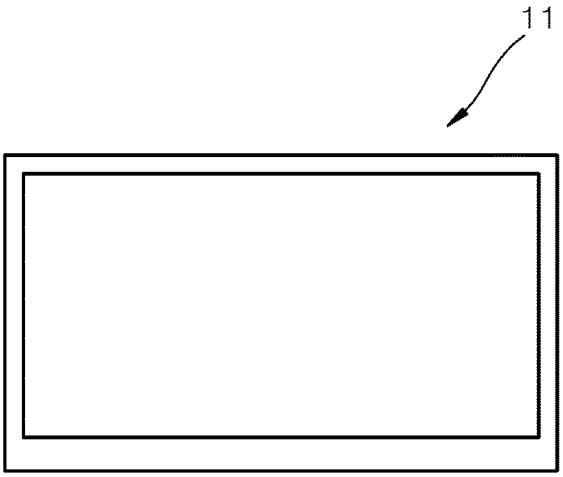
FIGS. 7A to 7D show steps of an example input procedure displayed on an example display in sequence.
Figure 7B:
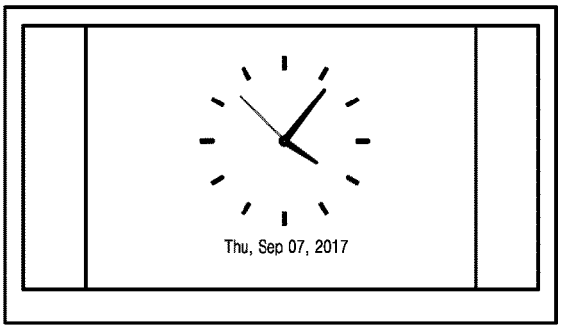

FIGS. 7A to 7D illustrate an example of the display. For example, when the user touches the display within the predetermined waiting time, the wait time is reset. In a normal mode, a display screen is off, as shown in FIG. 7A. When the user approaches the present device and the proximity sensor recognizes the presence of the user, a "welcome" indicating screen is displayed, and a current time and date is displayed as shown in FIG. 7B.

Figure 7C:
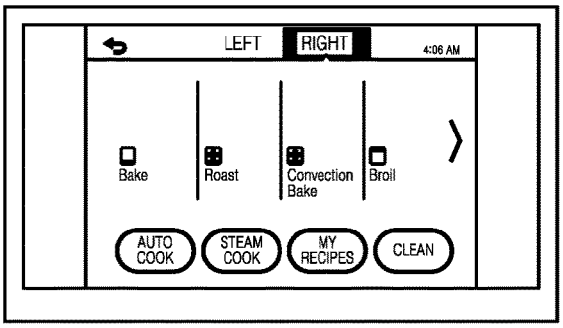
Figure 7D:
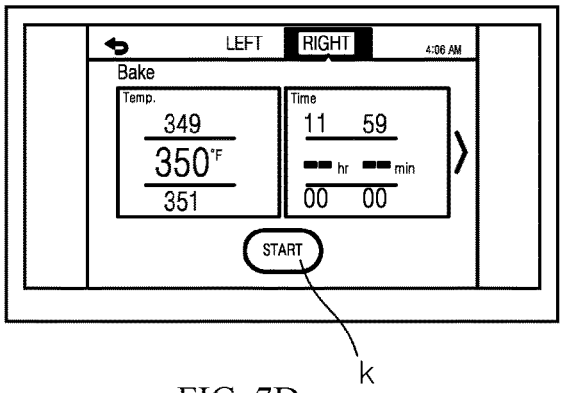

Then, when the user touches the screen, the waiting time is reset, and, as shown in FIG. 7C, a first menu screen for allowing selecting a type of cooking is displayed. Further, when the user selects an appropriate command on the first menu screen, the waiting time is reset, and, as shown in FIG. 7D, a second menu screen is displayed. That is, even when the welcome screen, the first menu screen, and the second menu screen are activated, the waiting time is measured. Then, when there is no manipulation to the screen by the user, the display may be turned off. Those may be performed under control of the control unit.

In some implementations, while the welcome screen, the first menu screen, and the second menu screen are activated, the user may press the power supply button. In a response, the display and illumination unit are turned off, as described above, and the opening command input interface is deactivated as described above. Similarly, while the welcome screen, the first menu screen, and the second menu screen are activated, the user may press the opening command input interface, for example, the "door open" button. In a response, the door is opened. Those operations may be performed under control of the control unit.

In some implementations, when the user presses a cooking-execution button k on the second menu screen, such as "cooking execution," "cooking start," "START," the oven starts to work. When the oven starts to operate, a red door LED 68 as described above is turned on, such that red light is irradiated upwardly from the door. This allows the user to be clearly and intuitively aware of the fact that the oven is working.

In some implementations, the user may open and close the oven while the cooking is in progress. In this connection, when the proximity sensor detects that there is a person in front of the cooker device, the opening command input interface is activated. As a result, when the user enters the opening command, the door may be automatically opened. This operation may be performed under control of the control unit.

In some implementations, when the door is opened during cooking, the door LED 68 is turned off. This allows the user not to be surprised or to feel dangerous by seeing the red light.

Further, as described above, the knock-on sensor 65 is disposed in the door. Thus, when the user knocks a surface of the door, especially a transparent surface facing the cooking chamber, the illumination unit illuminates the interior of the cooking chamber, allowing the user to see the inside of the cooker device from the outside.

This function works not only when executing cooking, but also when not executing cooking. Thus, when the user wants to look inside the cooking chamber, it may suffice that the user knocks the surface. Thus, the user may view the inside of the chamber without opening the door.

In some implementations, the cooker device has a child protection function.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

What is claimed is:

1. A cooker device comprising:

a main body that defines a cooking chamber and that defines an opening at a front of the main body;

a door configured to open and close at least a portion of the opening;

an opening assembly configured to apply force to the door and cause the door to pivot relative to the main body based on the force;

a proximity sensor configured to sense a proximity of an object located at a proximal region in front of the cooker device;

an input interface configured to receive an opening command and configured to be activated based on the object being detected in the proximal region by the proximity sensor, the input interface including an illumination unit;

a control unit configured to, based on the opening command, control the opening assembly to apply force to the door;

a display that is configured to indicate an operating state of the cooker device; and a power supply button configured to control a power supply to provide power to the input interface, the illumination unit, and the display, wherein the control unit is configured to:

based on the proximity sensor detecting the object in the proximal region, activate the input interface and turn on the illumination unit and the display, determine whether the power supply button of the cooker device has been pressed in a state in which the object is detected in the proximal region, based on a determination that the power supply button of the cooker device has been pressed in the state in which the object is detected in the proximal region, deactivate the proximity sensor, the illumination unit, the input interface, and the display, and maintain deactivation of the illumination unit, the input interface, and the display for a predetermined duration.

2. The cooker device of claim 1, wherein the door has:

a first upper region at which the input interface is located;

a second upper region at which the proximity sensor is located; and a central upper region located horizontally between the first upper region and the second upper region, and wherein the display is located at the central upper region of the door.

3. The cooker device of claim 1, wherein the input interface comprises at least one of a touch sensor configured to detect a touch input or a motion sensor configured to detect motion.

4. The cooker device of claim 1, wherein the opening assembly is located inside of the main body vertically above the cooking chamber.

5. The cooker device of claim 4, further comprising a hinge that is configured to pivotably couple the door to the main body, that is located at a bottom of the door, and that extends in a direction along the bottom of the door.

6. The cooker device of claim 5, further comprising an elastic unit configured to apply force to the door to cause the door to pivot toward the opening, wherein the control unit is configured to control the opening assembly to apply force to the door to cause the door to open to a position corresponding to a predetermined angle relative to the main body, and wherein the force applied by the elastic unit is less than a downward pivot force applied to the door due to the weight of the door based on the door being opened to the position corresponding to the predetermined angle.

7. A method for controlling opening of a door of a cooker device, the cooker device including a main body that defines a cooking chamber and that defines an opening at a front of the main body, a door configured to open and close at least a portion of the opening, an opening assembly configured to apply force to the door and cause the door to pivot relative to the main body, a proximity sensor configured to sense a proximity of an object located in front of the cooker device, an input interface configured to receive an opening command and configured to be activated based on the object being detected by the proximity sensor, the input interface including an illumination unit, a display that is configured to indicate an operating state of the cooker device, and a control unit configured to control the opening assembly, the method comprising:

monitoring, by the proximity sensor, an area in front of the cooker device;

detecting, by the proximity sensor, an object located at a proximal region within the area in front of the cooker device;

based on detection of the object in the proximal region, activating, by the control unit, the illumination unit;

turning on, by the control unit, the display based on detection of the object in the proximal region;

determining whether a power supply button of the cooker device has been pressed in a state in which the object is detected in the proximal region;

based on a determination that the power supply button of the cooker device has been pressed in the state in which the object is detected in the proximal region, deactivating, by the control unit, the proximity sensor, the illumination unit, the input interface, and the display; and maintaining, by the control unit, deactivation of the illumination unit, the input interface, and the display for a predetermined duration.

8. The method of claim 7, further comprising:

based on detection of the object in the proximal region, activating the input interface, by the control unit, to enable the input interface to receive the opening command; and in response to receipt of the opening command at the input interface, controlling, by the control unit, the opening assembly to apply force to the door to cause the door to pivot relative to the main body.

9. The method of claim 8, further comprising activating, by the control unit, the illumination unit and the input interface at a same time.

10. The method of claim 7, wherein the input interface comprises at least one of a touch sensor configured to detect a touch input or a motion sensor configured to detect motion, and wherein the method further comprises activating, by the control unit, the input interface and at least one of the touch sensor or the motion sensor at a same time.

11. The method of claim 7, further comprising:

deactivating, by the control unit, the proximity sensor based on the door being at least partially opened; and activating, by the control unit, the proximity sensor based on the door being closed.

12. The method of claim 7, wherein the display is further configured to detect touch on the display, and wherein the method further comprises deactivating, by the control unit, the display based on lack of detection of touch on the display for a wait time after activation of the display.

13. The method of claim 7, further comprising:

receiving an operation command at the display;

determining, by the control unit, an execution command corresponding to the operation command;

based on a determination that the operation command corresponds to an execution command for cooking, turning on, by the control unit, a light-emitting diode (LED) located on the door;

determining whether cooking is currently executed; and based on a determination that cooking is currently executed, controlling, by the control unit, the LED to maintain emission of light.

14. The method of claim 13, further comprising:

determining, by the control unit, whether the door is open while the LED emits light; and based on a determination that the door is open while the LED emits light, turning off, by the control unit, the LED.

15. The method of claim 7, wherein the opening assembly is located inside of the main body vertically above the cooking chamber.

16. The method of claim 15, wherein the cooker device further comprises a hinge that is configured to pivotably couple the door to the main body, that is located at a bottom of the door, and that extends in a direction along the bottom of the door.

17. The method of claim 16, wherein the cooker device further comprises an elastic unit configured to apply force to the door to cause the door to pivot toward the opening, wherein the method further comprises controlling, by the control unit, the opening assembly to apply force to the door to cause the door to open to a position corresponding to a predetermined angle relative to the main body, and wherein the force applied to the door toward the opening by the elastic unit is less than a downward force applied to the door by the weight of the door at the position corresponding to the predetermined angle.

18. The method of claim 17, further comprising slowing down a speed of a downward pivot motion of the door based on the door being opened to a position corresponding to an angle that is greater than or equal to the predetermined angle relative to the main body.

19. A cooker device comprising:

a main body that defines a cooking chamber and that defines an opening at a front of the main body;

a door configured to open and close at least a portion of the opening;

an opening assembly configured to apply force to the door and cause the door to pivot relative to the main body based on the force;

a proximity sensor configured to sense a proximity of an object located at a proximal region in front of the cooker device;

an input interface configured to receive an opening command and configured to be activated based on the object being detected in the proximal region by the proximity sensor, the input interface including an illumination unit;

a control unit configured to, based on the opening command, control the opening assembly to apply force to the door;

a display that is configured to indicate an operating state of the cooker device; and a power supply button configured to control a power supply to provide power to the input interface, the illumination unit, and the display, wherein the control unit is configured to:

based on the proximity sensor detecting the object in the proximal region, activate the input interface and turn on the illumination unit and the display, determine whether the power supply button of the cooker device has been pressed in a state in which the object is detected in the proximal region, based on a determination that the power supply button of the cooker device has been pressed in the state in which the object is detected in the proximal region, deactivate the proximity sensor, the illumination unit, the input interface, and the display, and maintain deactivation of the proximity sensor for a predetermined duration.

* * * * *